US005861858A

United States Patent [19]

Niekamp

[11] Patent Number: 5,861,858

[45] Date of Patent: Jan. 19, 1999

[54] ANTENNA FEED AND SUPPORT SYSTEM

[75] Inventor: Rex Leonard Niekamp, Quincy, Ill.

[73] Assignee: Harris Corporation, Melbourne, Fla.

[21] Appl. No.: 885,370

[22] Filed: Jun. 30, 1997

[51] Int. Cl.[6] ..... H01Q 21/12

[52] U.S. Cl. ..... 343/800; 343/890

[58] Field of Search ..... 343/800, 890, 343/795

[56] References Cited

U.S. PATENT DOCUMENTS

| | | | |
|---|---|---|---|
| 2,480,154 | 1/1949 | Masters . | |
| 4,468,671 | 8/1984 | Ellingson et al. | 343/766 |
| 4,473,827 | 9/1984 | Ellingson et al. | 343/890 |
| 4,794,401 | 12/1988 | Murashimas | 343/890 |
| 4,799,642 | 1/1989 | Wright | 343/890 |
| 5,097,647 | 3/1992 | Sopik et al. | 343/878 |
| 5,446,473 | 8/1995 | Nielsen | 343/890 |
| 5,467,955 | 11/1995 | Beyersmith | 343/890 |
| 5,649,402 | 7/1997 | Moore | 343/890 |

*Primary Examiner*—Frank G. Font
*Assistant Examiner*—Tu Nguyen
*Attorney, Agent, or Firm*—Tarolli, Sundheim, Covell, Tummino & Szabo

[57] ABSTRACT

An antenna system is presented having a feed for feeding an antenna and apparatus for supporting the feed. The system includes a vertically oriented, electrically conductive hollow mast which carries first and second groups of vertically spaced bays of radiating elements. Each bay includes an arrangement of N radiating elements extending outward from the mast. N vertically oriented electrically conductive, hollow feed support members are spaced away from the mast. Each support member carries an elongated feed conductor extending vertically within the support member. The support members extend vertically upward coextensively with that of the mast to approximately midway between said first and second groups of bays. N hollow electrically conductive, coupling arms are provided and each arm extends between the mast and one of the N support members. Each arm carries first and second conductors each connected at one end to a feed conductor. The first conductor extends upwardly within the mast to feed the first group. The second conductor extends downwardly within the mast to feed the second group.

21 Claims, 6 Drawing Sheets

ANTENNA FEED AND SUPPORT SYSTEM

FIELD OF THE INVENTION

This invention relates to an antenna system having a feed for feeding the antenna and apparatus for supporting the feed.

DESCRIPTION OF THE PRIOR ART

It is known in the prior art to provide an antenna having a vertically oriented mast which carries several bays of antenna elements. The bays are vertically spaced from each other and may, for example, include an arrangement of four dipole elements with the elements in each bay being spaced apart by 90° from each other. This arrangement of antenna elements is sometimes known as a turnstile arrangement with the elements in each bay being fed by energy which is phase displaced in the order of 0°, 90°, 180° and 270°. The feed to each radiating element is obtained from conductors which extend upwardly within the mast or externally of the mast. Thus four conductors are employed for feeding the four radiating elements in each bay. In such case, if twelve bays of radiating elements are employed then the four radiating elements per bay will require a total of 48 conductors extending upwardly along-side or within the mast. A prior art antenna system along the lines described above is disclosed in the U.S. Patent to R. W. Masters U.S. Pat. No. 2,480,154.

A problem encountered with turnstile antennas as described above deals with the need to support the multiple conductors that are extending upwardly along or within the vertical mast to feed the radiating elements of each bay. This becomes particularly cumbersome with a large number of bays. Thus, twelve bays with four radiating elements for each bay requires 48 conductors.

SUMMARY OF THE INVENTION

It is an object of the present invention to provide improvements in the feed for an antenna and for supporting the feed.

In accordance with the present invention, an antenna system is providing having a feed for feeding an antenna as well as apparatus for supporting the feed. This antenna includes a vertically oriented, electrically conductive, hollow mast. First and second groups of vertically spaced bays of radiating elements are carried by the mast. Each bay includes an arrangement of N radiating elements extending outward from the mast. N vertically oriented electrically conductive hollow feed support members are spaced away from the mast. Each support member carries an elongated feed conductor extending vertically within the support member. The support members extend vertically upward coextensively with that of the mast to approximately midway between the first and second groups of bays. N hollow electrically conductive coupling arms are provided. Each arm extends between the mast and one of the N support members and carries first and second conductors each connected at one end to a feed conductor and then extending into the mast. The first conductor extends upwardly within the mast to feed the first group and the second conductor extends downwardly within the mast to feed the second group.

BRIEF DESCRIPTION OF THE DRAWINGS

The foregoing and other objects and advantages of the invention will become more readily apparent from the following description of a preferred embodiment as taken in conjunction with the accompanying drawings which are a part hereof and wherein.

DESCRIPTION OF PREFERRED EMBODIMENT

Figure 1:
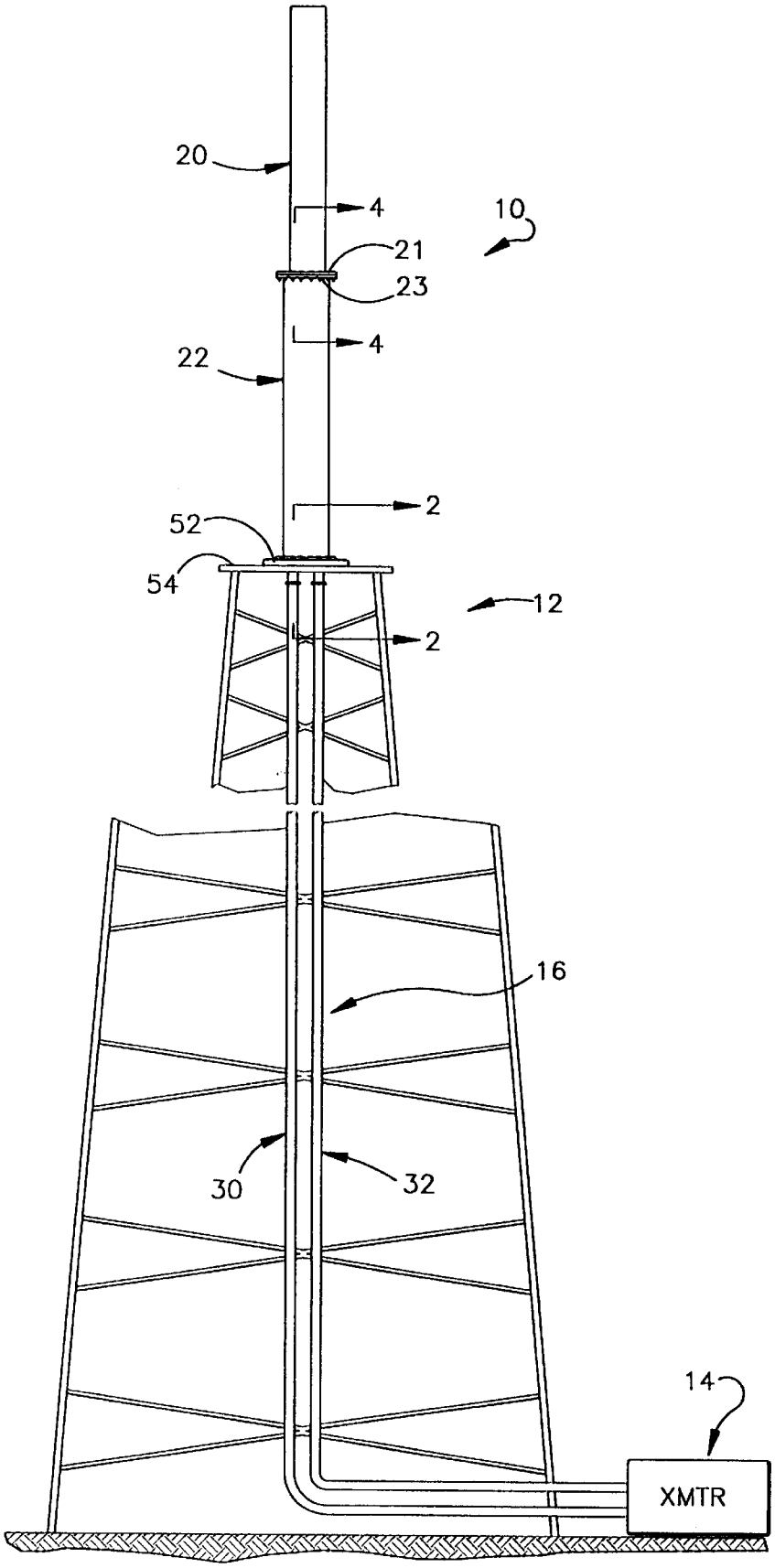
FIG. 1 is an elevational view, partly in section, illustrating an antenna, mounted on top of a tower, and which antenna is constructed in accordance with the present invention.

Reference is now made to the drawings wherein the showings are for purposes of illustrating a preferred embodiment of the invention only, and not for purposes of limiting same. FIG. 1 illustrates an antenna 10 mounted on top of a tower 12 with the antenna being fed with radio frequency (RF) signals from a transmitter 14. The antenna 10 is coupled to the transmitter 14 by way of a feed system 16 to be described in greater detail hereinafter.

The antenna 10 may be a UHF antenna having several bays of radiating elements. As shown in FIG. 1, the antenna includes an upper section and a lower section each being illustrated as having a radome 20 or 22 which covers the antenna elements. Such radomes are known in the art and are typically comprised of non-conductive material, such as plastic, to protect the radiating elements and for providing a low resistance to wind conditions. The antenna 10 may have a length on the order of 50 feet and is supported by the tower 12. The tower 12 may be of conventional design and may have a tower height on the order of 1,000 feet. The RF transmitter 14 supplies RF energy to the transmission feed system 16 which, in turn, supplies RF energy to the antenna 10.

The transmission feed system 16, in the example being presented herein, includes four (4) rigid coaxial transmission feeds each including a horizontal portion and a vertical portion which extends up within the tower 16 to feed the antenna 10. Two (2) of these coaxial feeds, 30 and 32, are illustrated in FIG. 1 with the other two (2) coaxial feeds, 34 and 36, being illustrated in other views, such as in FIG. 6 or 9.

Figure 6:
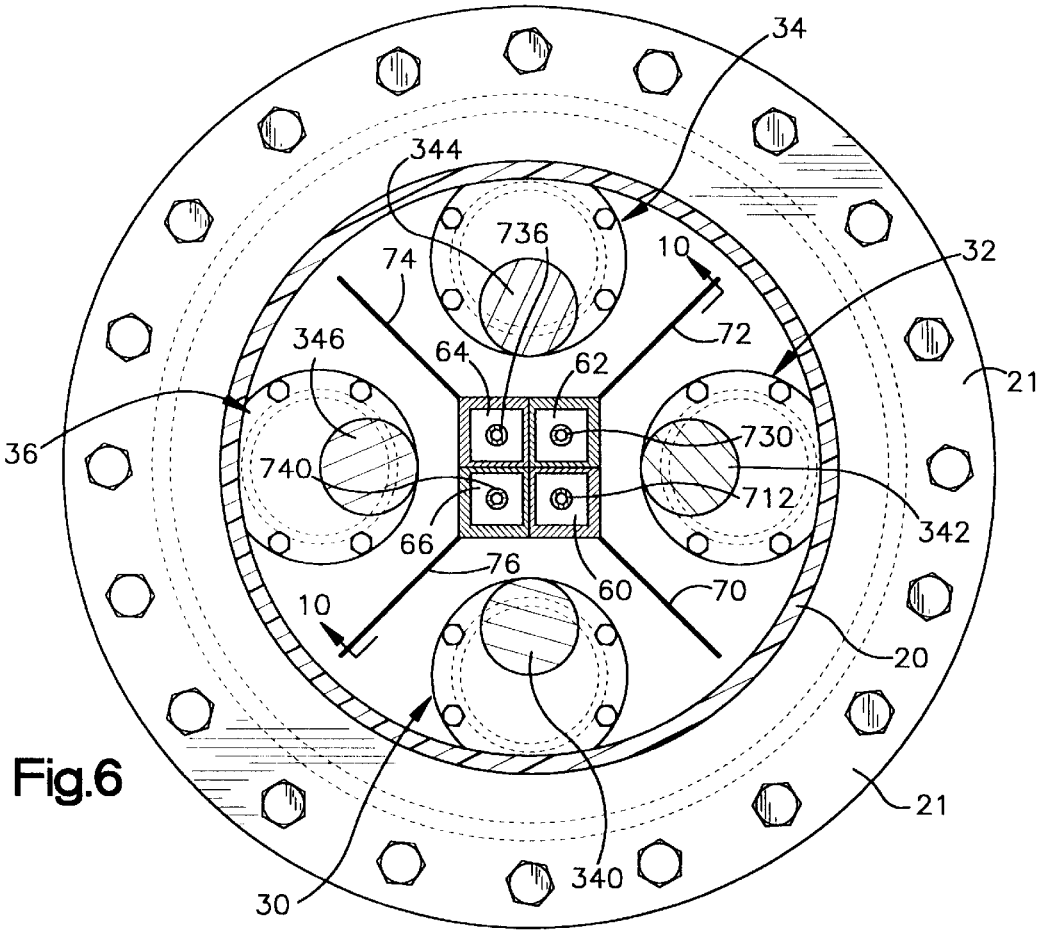
FIG. 6 is a view taken generally along line 6—6 looking in the direction of the arrows in FIG. 4.
Figure 7:
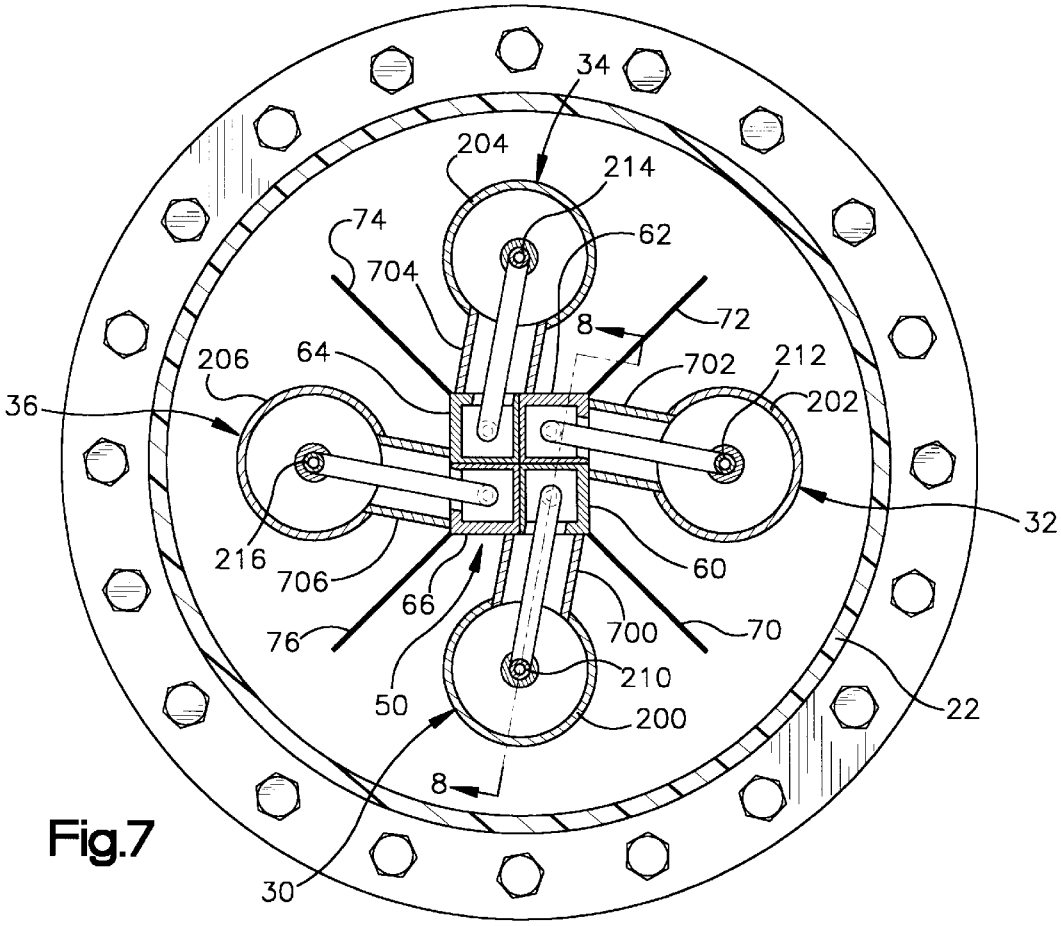
FIG. 7 is an enlarged view taken generally along line 7—7 looking in the direction of the arrows in FIG. 4.
Figure 9:
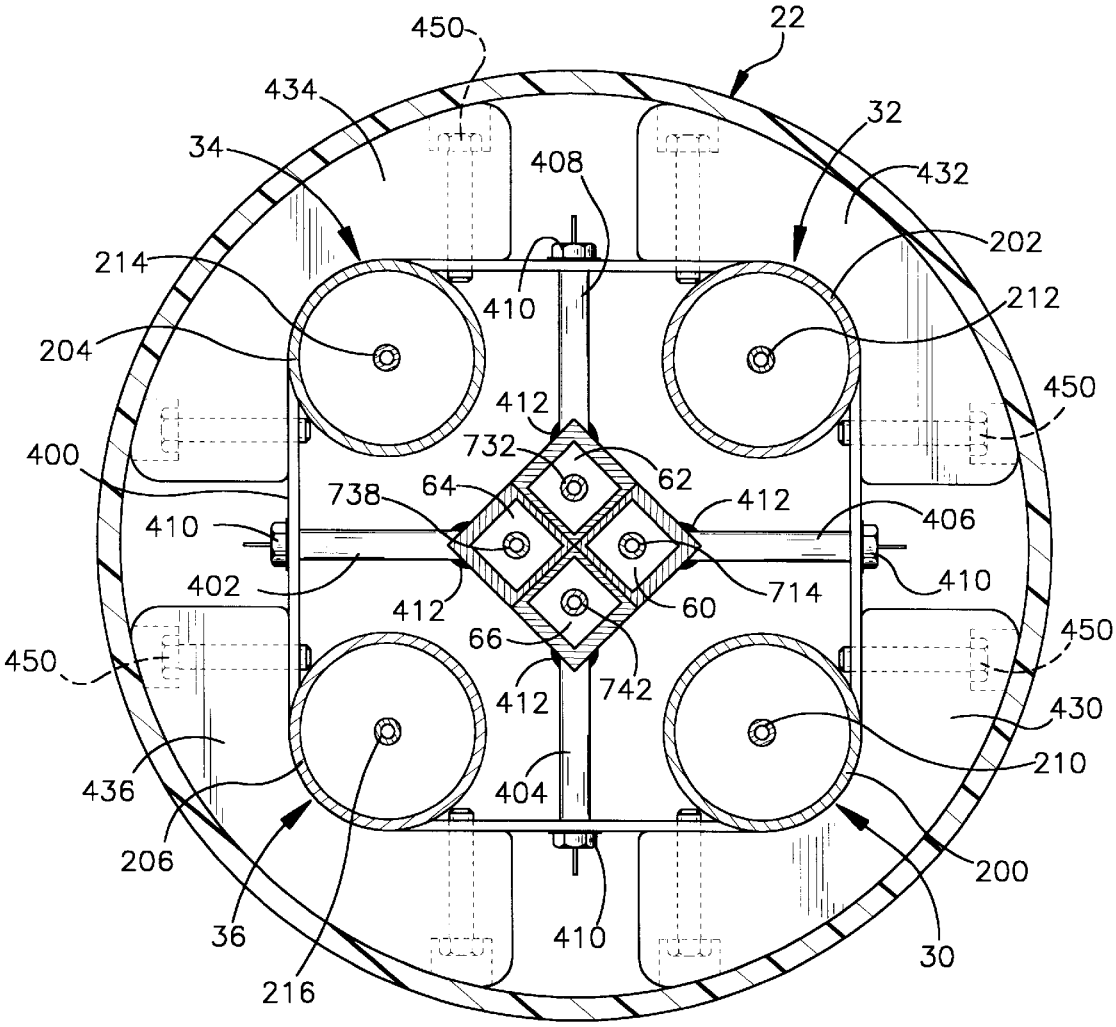
FIG. 9 is an enlarged view taken generally along line 9—9 looking in the direction of the arrows in FIG. 5.
Figure 10:
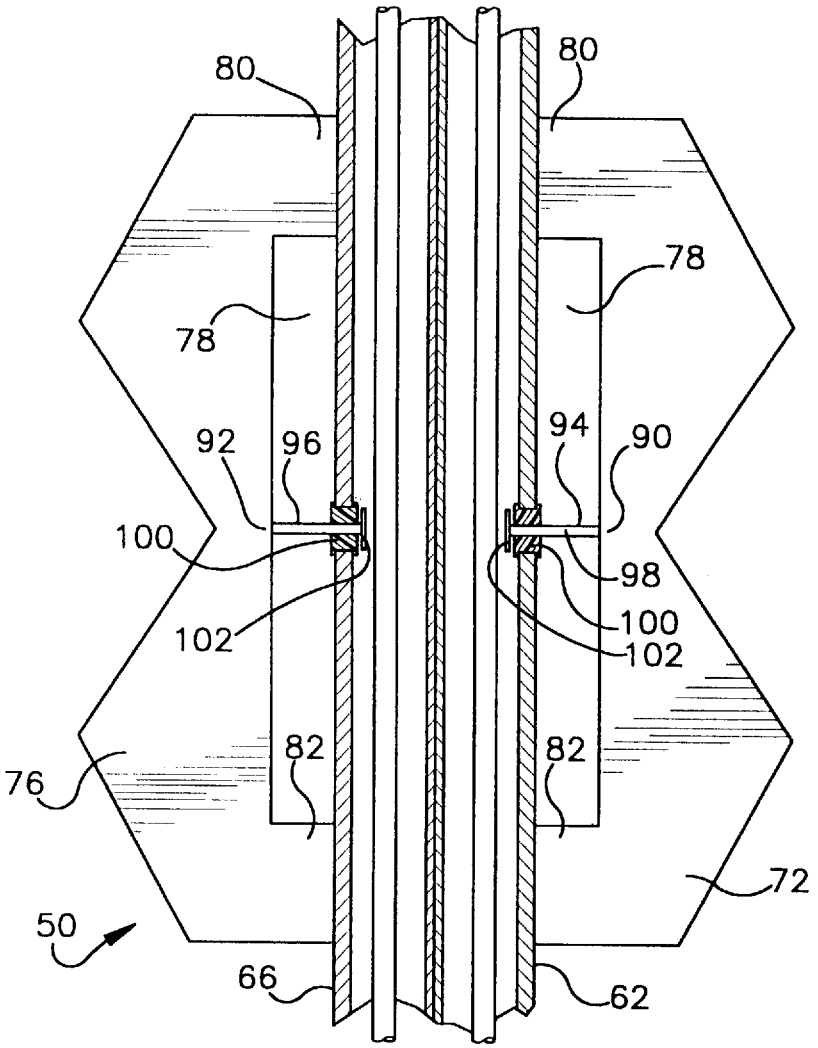
FIG. 10 is a view taken generally along line 10—10 looking in the direction of the arrows in FIG. 6.

The antenna 10 (FIG. 2) includes a central hollow mast 50 which extends upwardly from an antenna base plate 52 and which, in turn, is carried on top of the tower top plate 54. The mast 50 is made up of four (4) square shaped mast tubes 60, 62, 64, and 66 which are best illustrated in FIGS. 6, 7, and 9. These tubes are coextensive with and together they define the mast 50. The mast carries first and second groups of vertically spaced bays of radiating elements. The first group of radiating elements is located within the upper radome 20 and the second group of radiating elements is located within the lower radome 22. The elements within each bay are identical and include four (4) dipole wing elements located 90° apart and spaced in a coaxial array about the mast. Four of these wing elements, within radome 22, are illustrated in FIGS. 6 and 10 including wing elements 70, 72, 74, and 76. These wing elements are attached to the mast 50. FIG. 10 shows wing elements 72 and 76 as being attached to the mast 50. Each of the wing elements is a flat M shaped element having a cut away central portion 78 and upper and lower leg portions 80 and 82. The upper leg portions 80 of wing elements 72 and 76 are secured, as by welding, to mast 50 at mast tubes 62 and 66 respectively. Similarly, the lower leg portions 82 of wing elements 72 and 76 are secured, as by welding, to mast 50 at tubes 62 and 66 respectively. The center feed points 90 and 92 of wing elements 72 and 76 are respectively connected to coupling devices 94 and 96. These coupling devices each include a rod 98 which extends from the feed point 90 (or 92) and thence through an insulator 100, carried by tube 62 (or 66) terminating in a disc-like element 102 located within the tube 62 (or 66), for coupling RF energy from within the tube to the associated feed point 90 (or 92). Each of these tubes carries a conductor that receives RF energy from the transmitter 14 and this energy is coupled by way of the coupling devices for energizing the radiating elements in each bay.

There are four (4) radiating elements located in each bay and these includes wing elements 70, 72, 74, and 76. In this embodiment of the invention, these wing elements are energized by RF energy having a phase relationship of 0°, 90°, 180° and 270°. The feeds for these antenna elements (FIG. 6) include feeds 30, 32, 34, and 36 respectively. As will be brought out hereinafter, each feed carries a conductor which is provided with RF energy of the required phase relationship for feeding the wing elements. That is, the phase relationship of the Rf energy carried by the conductors in feeds 30, 32, 34, and 36 is of 0°, 90°, 180°, and 270° respectively.

Figure 2:
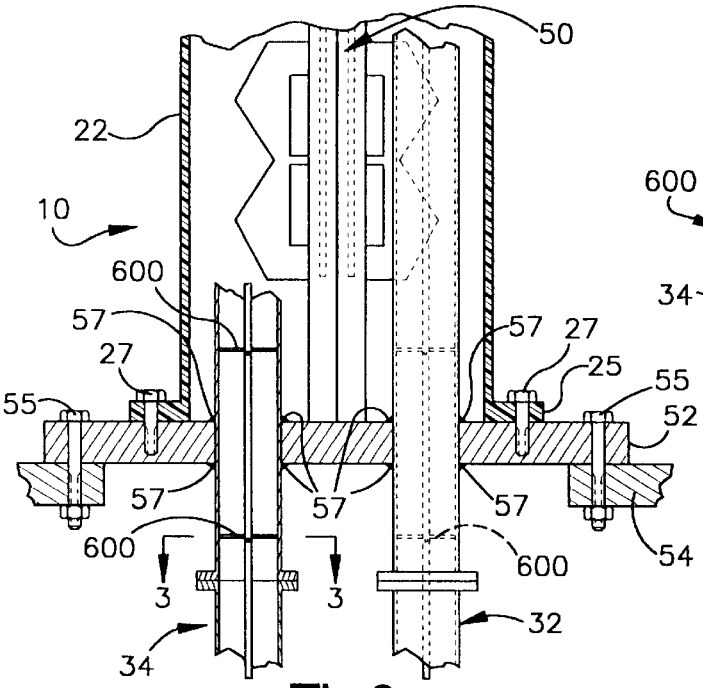
FIG. 2 is a view taken generally along line 2—2 looking in the direction of the arrows in FIG. 1.

As best shown in FIGS. 2, 7, and 9, the feeds include rigid support feed tubes 200, 202, 204, and 206. These are cylindrical tubular members constructive of conductive material, such as steel, and each coaxially surrounds and carries a center conductor. Thus, support feed tubes 200, 202, 204, and 206 coaxially surround conductors 210, 212, 214, and 216 respectively. These tubes extend through suitable apertures in the antenna base plate 52 and are secured thereto, as by welds 57. The feed tubes together with the conductors carried thereby extend vertically upward coextensively with the lower section of the antenna covered by radome 22 to a point 300 (see FIGS. 4 and 5) which is essentially midway between the upper antenna section and the lower antenna section. Thus, point 300 divides the antenna between the upper radiating elements and the lower radiating elements. At this location, the upper radome 20 has an outwardly extending annular radial flange 21 and the lower radome 22 has an outwardly extending annular flange 23. These flanges 21 and 23 are secured together as with suitable nut and bolt arrangements 302 (see FIGS. 4 and 5).

Figure 8:
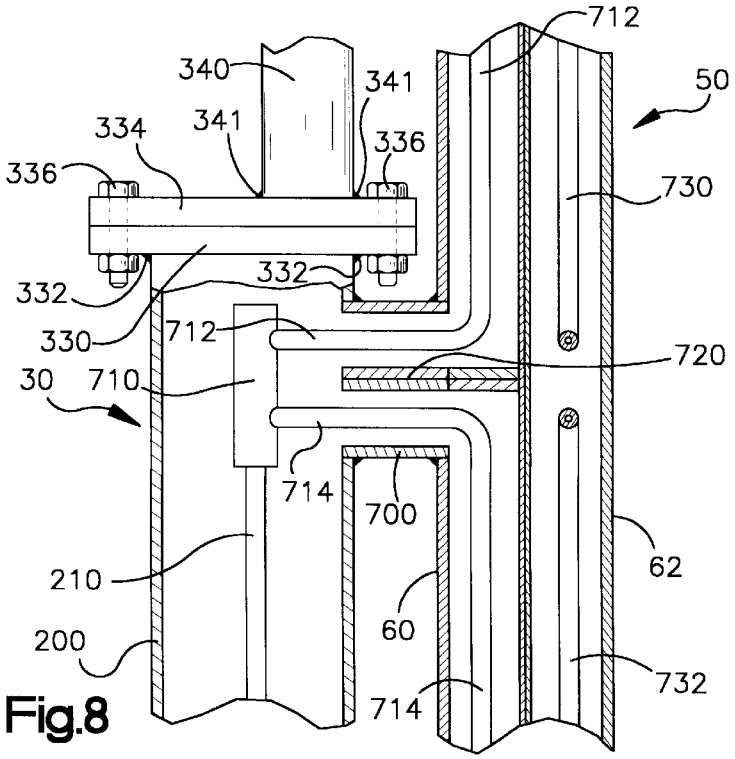
FIG. 8 is a view taken generally along line 8—8 looking in the direction of the arrows in FIG. 7.

Each of the support feed tubes extends upwardly within radome 22 to approximately the mid-point 300. Each of the support tubes has a disc-like plate 330 which covers its upper end, as is best seen in FIG. 8. Cap 330 may be welded at 332 to the upper end of its associated feed tube, such as feed tube 30 a s show n in FIG. 8. In addition, another disc-like plate 334 is mounted on top of plate 330 and secured thereto as with suitable nut and bolt arrangements 336, see FIG. 8. On top of each plate 334 there is provided an upper support 340 which has its lower end secured to plate 334, as by a weld 341. There are four (4) upper supports 340, 342, 344, and 346 (FIG. 6). Upper support 340 extends upwardly from feed tube 30 as described with reference to FIG. 8. In a similar manner, upper support 342 extends upwardly from feed tube 32, upper support 344 extends upwardly from feed tube 34, and upper support 346 extends upwardly from feed tube 36. The upper supports 340, 342, 344, and 346 may each be constructed of a solid, elongated metal rod, such as steel.

Figure 4:
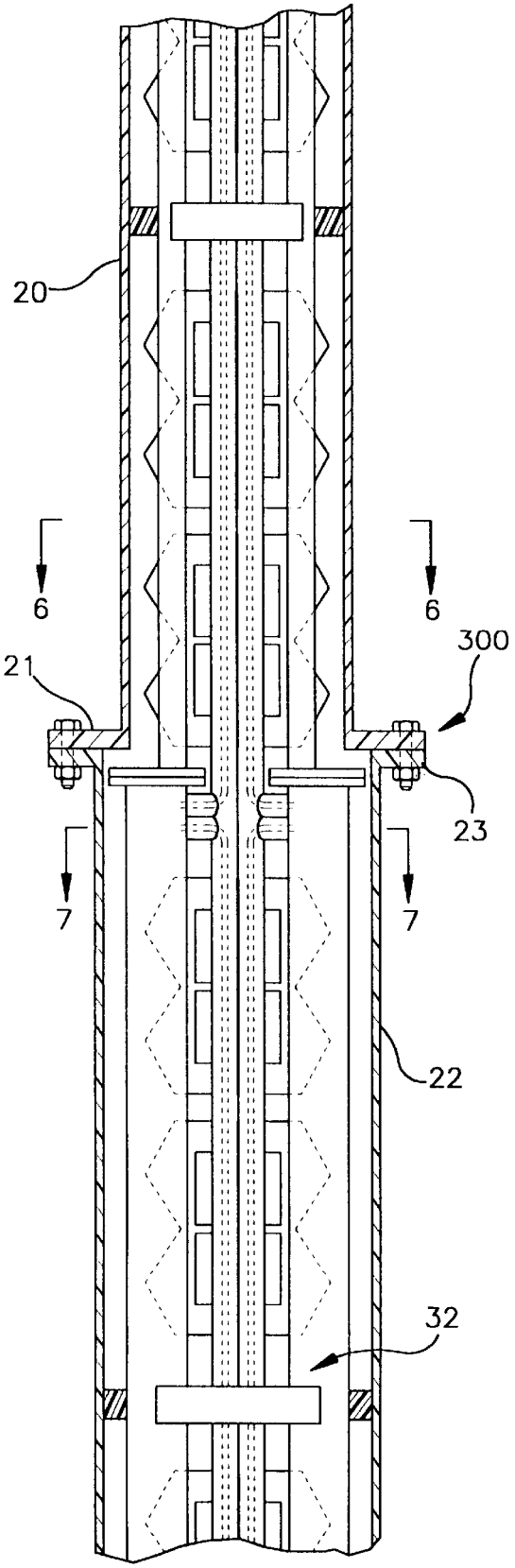
FIG. 4 is an enlarged sectional view taken generally along line 4—4 looking in the direction of the arrows in FIG. 1.
Figure 5:
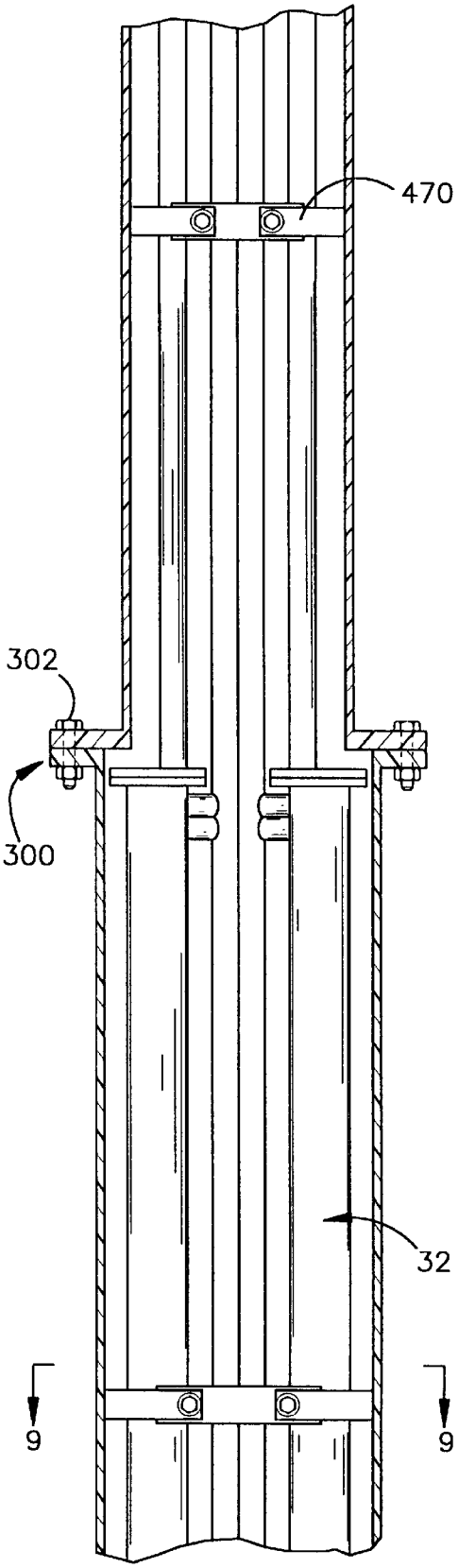
FIG. 5 is a view similar to that of FIG. 4, but not showing the radiating elements or wings in FIG. 4.

The lower support feed tubes 200, 202, 204, and 206, as best shown in FIGS. 4, 5, and 9, are interconnected by means of a structural support tie 400. Support tie 400 is a metal strap that wraps about the feed tubes, as shown in FIG. 9. Feed structure support arms 402, 404, 406, and 408 extend from the respective four corners of mast 50 to the structural support tie 400 and are secured thereto as with suitable nut and bolt arrangements 410. The inner ends of arms 402, 404, 406, and 408 are each secured to a respective corner of the mast 50, as with suitable welds 412.

Four radome support bumpers 430, 432, 434, and 436 are interposed between the structural support tie 400 and the inner surface of the lower radome 22. These support bumpers are made of non-conductive material, such as plastic, and are somewhat C-shaped in cross section and are located at the corners defined by support feed tubes 200, 202, 204, and 206. The bumpers are held in place as with suitable attachment bolts 450 which connect the associated bumper with the structural support tie 400. It is contemplated that the lower radome be provided with several radome support bumper and structural tie arrangements as shown in FIGS. 5 and 9. Such arrangements are spaced vertically apart from each other, as desired. Also, similar upper radome support bumper and structural tie arrangements 407 are employed and which differ from the lower radome arrangements by being of slightly smaller size.

Figure 3:
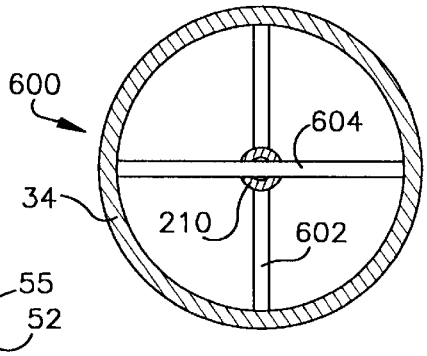
FIG. 3 a view taken generally along line 3—3 looking in the direction of the arrows in FIG. 2.

Reference is now made to FIGS. 2 and 3 which show a plurality of non-conductive support arrangements 600 which are employed for purposes of supporting the inner conductors within the tubes 30, 32, 34, and 36 (or within tubes 200, 202, 204, and 206). As best shown in FIG. 3, the inner conductor, such as conductor 210 located within tube 32, is tubular in shape. This inner conductor is held in place to the tube 32 by means of non-conductive pins 602 and 604 which extend through suitable apertures in the inner conductor 210 and secured to the inner walls of tube 32. These support arrangements 600 are spaced vertically within the support feed tubes, as desired.

Referring again to FIG. 2, it is seen that radome 22 has a lower annular flange 25 which rests on top of the antenna base plate 52 and is secured thereto by means of suitable nut and bolt arrangements 27. Also, the antenna base plate 52 is secured to the tower top plate 54 by suitable nut and bolt arrangements 55. The support feed tubes 30, 32, 34, and 36 extend vertically through suitable apertures in the antenna base plate 52 and are secured to the base plate 52, as with suitable welds 57.

Reference is now made to FIGS. 7 and 8 which illustrate four (4) hollow, electrically conductive coupling arms 700, 702, 704, and 706. As is seen in FIG. 7, arm 700 couples the support feed tube 30 with mast tube 60. Arm 702 couples the support feed tube 32 with mast tube 62. Similarly, arm 704 couples the support feed tube 34 with mast tube 64 and arm 706 couples the support feed tube 36 with mast tube 66. As will brought out herein below, each of the coupling arms is hollow and carries therein first and second conductors.

These conductors are each connected at one end to a vertically extending inner feed conductor, such as conductor 210 in the support feed tube 30. The first conductor extends within the mast and then extends upwardly to feed the first group of radiating elements within radome 20 and the second conductor extends downwardly to feed the second group of radiating elements within radome 22.

Each of these arms is constructed as described in detail herein with reference to arm 700 illustrated in FIG. 8. As shown in FIG. 8, arm 700 is hollow and couples the interior of tube 30 with the interior of mast tube 60. The upper end of conductor 210 is electrically connected by way of a sleeve to a first upper conductor 712 and a second lower conductor 714. Conductor 712 extends from conductor 210 and, thence, through arm 700 to the interior of mast tube 60 and then extends upwardly within mast tube 60 to feed one radiating element in each of the upper bays within radome 20. Similarly, conductor 714 extends into the interior of mast tube 60 and then downwardly to feed one radiating element in each bay within the lower radome 22. The conductors 712 and 714 are each supplied with the same phase of energy such as 0°, or 90°, or 180°, or 270°. The conductors 712 and 714 within arm 700 are separated by a baffle 720 which helps to properly direct the energy within the upper and lower portions of mast tube 60.

Each of the mast tubes 60, 62, 64, and 66 have first (or upper) and second (or lower) conductors carried in the same manner as that discussed herein with reference to FIG. 8. Thus, mast tube 62, as shown in FIGS. 6, 8, and 9, has an upper conductor 730 and a lower conductor 732. Similarly, mast tube 64 contains an upper conductor 736 and a lower conductor 738. Also, mast tube 66 contains an upper conductor 740 and a lower conductor 742.

The transmitter 14 supplies RF energy to the feed tubes 30, 32, 34, and 36 such that the inner conductors 210, 212, 214, and 216 are fed having a phase relationship of 0°, 90°, 180°, and 270° respectively. The support tubes 200, 202, 204, and 206 are connected to electrical ground.

From the above description of the invention, those skilled in the art will perceive improvements, changes and modifications. Such improvements, changes and modifications within the skill of the art are intended to be covered by the appended claims.

Having described the invention, the following is claimed:

1. An antenna system having a feed for feeding an antenna and apparatus for supporting said feed, comprising:

a vertically oriented, electrically conductive hollow mast;

first and second groups of vertically spaced bays of radiating elements carried by said mast, each bay including an arrangement of N radiating elements extending outward from said mast;

N vertically oriented electrically conductive, hollow feed support members spaced away from said mast, each said support member carrying an elongated feed conductor extending vertically within said support member, said support members extending vertically upward coextensively with that of said mast to approximately midway between said first and second groups of bays; and N hollow electrically conductive, coupling arms each extending between said mast and one of said N support members and carrying first and second conductors each connected at one end to a said feed conductor and said first conductor extending upwardly within said mast to feed said first group and said second conductor extending downwardly within said mast to feed said second group.

2. An antenna system as set forth in claim 1, wherein said mast includes N mast tubes, each mast tube being coextensive with said mast.

3. An antenna system as set forth in claim 2, wherein each said first conductor extends upwardly within one of said N mast tubes and each said second conductor extends downwardly within one of said N mast tubes.

4. An antenna system as set forth in claim 3, wherein each said radiating element has a feed end and means for coupling RF energy from one of said first and second conductors to said feed end.

5. An antenna system as set forth in claim 4, wherein each said radiating element is a dipole element.

6. An antenna system as set forth in claim 5, wherein N equals four.

7. An antenna system as set forth in claim 5, wherein each said dipole element is a flat dipole wing element.

8. An antenna system as set forth in claim 7, wherein N equals four and said wing elements are spaced 90° apart from each other about said mast in a turnstile arrangement.

9. An antenna system as set forth in claim 1 including an antenna support structure for supporting said antenna, said support structure having a support plate, said mast having a lower end carried by said support plate, said N feed support members being mounted to and carried by said support plate.

10. An antenna system as set forth in claim 9, wherein said support structure includes a tower.

11. An antenna system as set forth in claim 9, wherein said mast includes N mast tubes, each mast tube being coextensive with said mast.

12. An antenna system as set forth in claim 11, wherein each said first conductor extends upwardly within one of said N mast tubes and each said second conductor extends downwardly within one of said N mast tubes.

13. An antenna system as set forth in claim 12, wherein each said radiating element has a feed end and means for coupling RF energy from one of said first and second conductors to said feed end.

14. An antenna system as set forth in claim 13, wherein each said radiating element is a dipole element.

15. An antenna system as set forth in claim 14, wherein N equals four.

16. An antenna system as set forth in claim 14, wherein each said dipole element is a flat dipole wing element.

17. An antenna system as set forth in claim 16, wherein N equals four and said wing elements are spaced 90° apart from each other about said mast in a turnstile arrangement.

18. An antenna structure comprising:

a first elongated antenna bay including a plurality of antennas, each of the antennas being separated longitudinally by mounting on a centrally located elongated support element, each of said plurality of antennas including an equal number of a plurality of radiating elements extending circumferentially from the centrally located support element and separated by equal angular arcs, and wherein the support elements include a plurality of signal feed elements wherein the support elements and signal feed elements form a plurality of coaxial feed lines, one line for each of the angular arcs of the plurality of radiating elements, a second elongated antenna bay including a plurality of antennas, each of the antennas being separated longitudinally by mounting on a centrally located elongated support element, each of said plurality of antennas including an equal number of a plurality of radiating elements extending circumferentially from the support element and separated by equal angular arcs, and wherein the support element includes a plurality of signal feed elements wherein the support elements and signal feed elements form a plurality of coaxial feed lines, one line for each of the angular arcs of the plurality of radiating elements, a plurality of support member feed lines corresponding to the number of coaxial feed lines in the first and second antenna bays extending longitudinally through the second bay for providing a support structure for the first and second antenna bays, the support members being formed of a hollow shaft supporting member and an inner conductor, wherein the support members form a plurality of coaxial feed lines, means adapted for mounting the first antenna bay longitudinally onto the second antenna bay wherein the second bay is adapted to vertically support the first antenna bay, and coupling means adjacent the mounting means, for coupling separate ones of the plurality support member feed lines to the coaxial feed lines in the first and second antenna bays.

19. An antenna structure comprising:

first and second elongated antenna bays, each bay including a plurality of turnstile antennas, each of the antennas being separated longitudinally by mounting on a centrally located elongated support element, each of said plurality of antennas including four radiating elements, and wherein the support element includes four signal feed elements forming coaxial feed lines, one coaxial feed line for each of the radiating elements, four support member feed lines extending longitudinally through the second bay for providing a support structure for the first and second antenna bays, the support members being formed of a hollow shaft supporting member and an inner conductor, wherein the support members and inner conductors form four coaxial feed lines, means adapted for vertically mounting the first antenna bay onto an end of the second antenna bay and longitudinally therewith wherein the four support member feed lines of the second bay provide vertical support the first antenna bay, and coupling means adjacent the mounting means, for coupling separate ones of the four support member feed lines to separate ones of the four coaxial feed lines in each of the first and second antenna bays.

20. A base antenna structure comprising:

an elongated base antenna bay including a plurality of antennas, each of the antennas being separated longitudinally by mounting on a centrally located elongated support element, each of said plurality of antennas including an equal number of a plurality of radiating elements extending circumferentially from the centrally located support element and separated by equal angular arcs, and wherein the support element include a plurality of signal feed elements wherein the support elements and signal feed elements form a plurality of coaxial feed lines, one line for each of the angular arcs of the plurality of radiating elements, a plurality of support member feed lines corresponding to the number of coaxial feed lines in the antenna bay extending longitudinally through the base antenna bay for providing a support structure for the base antenna bay, the support members being formed of a hollow shaft supporting member and an inner conductor, wherein the support members form a plurality of coaxial feed lines, means adapted for mounting an additional elongated antenna bay having a plurality of antennas of similar construction longitudinally onto the base antenna bay wherein plurality of support member feed lines of the base antenna bay are adapted to provide vertical support for the additional antenna bay, and coupling means adjacent the mounting means, for coupling separate ones of the plurality support member feed lines to the coaxial feed lines in the base antenna bay and adapted to be coupled to the coaxial feed lines in the additional antenna bay.

21. A method of providing a combined signal feed element and structural member for supplying signals for an antenna structure including first and second elongated antenna bays wherein each antenna includes a plurality of antennas mounted serially on an elongated structure and wherein signal feed lines run along the elongated structure and are coupled to the antennas, the method comprising:

mechanically coupling the first and second antenna bays together into a single elongated antenna structure for vertical mounting of the first antenna bay on the second antenna bay, providing a plurality of rigid elongated conductive hollow structural members extending the length of the second antenna bay formed as transmission lines, wherein the structural elements function as support members for the vertical antenna structure as well as signal transmission lines, and coupling the transmission lines to the first and second antenna bay signal feed lines adjacent the point at which the first and second antenna bays are mechanically coupled together.

* * * * *